US009222358B2

(12) United States Patent
Hoeft et al.

(10) Patent No.: US 9,222,358 B2
(45) Date of Patent: Dec. 29, 2015

(54) SEALING ARRANGEMENT FOR SHAFT AND TUNNEL CONSTRUCTIONS

(75) Inventors: Heiko Hoeft, Rosengarten (DE); Holger Gutschmidt, Neu Wulmstorf (DE); Andreas Diener, Pattensen (DE); Andreas Artus, Tabarz (DE); Marc Fischer, Teutleben (DE); Matthias Klug, Eisenach (DE)

(73) Assignee: Daetwyler Sealing Technologies Deutschland GmbH, Waltershausen (DE)

( * ) Notice: Subject to any disclaimer, the term of this patent is extended or adjusted under 35 U.S.C. 154(b) by 179 days.

(21) Appl. No.: 13/516,329

(22) PCT Filed: Nov. 29, 2010

(86) PCT No.: PCT/DE2010/050086

§ 371 (c)(1),
(2), (4) Date: Sep. 14, 2012

(87) PCT Pub. No.: WO2011/063804

PCT Pub. Date: Jun. 3, 2011

(65) Prior Publication Data

US 2012/0328369 A1 Dec. 27, 2012

(30) Foreign Application Priority Data

Nov. 30, 2009 (DE) ..... 10 2009 056 063

(51) Int. Cl.
*E21D 11/38* (2006.01)
*E02D 29/16* (2006.01)
*F16J 15/06* (2006.01)

(52) U.S. Cl.
CPC ..... *E21D 11/385* (2013.01)

(58) Field of Classification Search
CPC ..... E21D 11/385; E21D 11/05; E21D 11/08; E21D 11/083; E02D 29/16; E04B 1/68
USPC ..... 405/135, 147, 152, 179; 52/396.06; 404/64, 65; 277/625, 626, 594; 166/242.1–242.9
See application file for complete search history.

(56) References Cited

U.S. PATENT DOCUMENTS 4,195,850 A 4/1980 Berger et al.
4,199,158 A * 4/1980 de Munck ..... 277/648

(Continued)

FOREIGN PATENT DOCUMENTS

DE 2910090 A1 9/1979
DE 19603188 A1 8/1996

(Continued)

OTHER PUBLICATIONS

English translation of International Preliminary Report on Patentability dated Sep. 25, 2012.

*Primary Examiner* — John Kreck
*Assistant Examiner* — Stacy Warren
(74) *Attorney, Agent, or Firm* — Patent Central LLC; Stephan A. Pendorf

(57) ABSTRACT

A sealing arrangement for shaft and tunnel constructions. The sealing of gaps between components of shaft and tunnel constructions is improved, in particular if the components are misaligned. For this purpose a) the sealing arrangement (1) comprises at least two components (2), which lie against each other at butt sides (3) so as to form a gap (4), b) the components (2) have an elastic sealing profile (5) on each butt side (3), and c) the sealing profiles (5) of the butt sides (3) that lie against each other lie against each other on a contact plane (6) and bridge the gap (4) in a sealing manner. The sealing profiles (5) have areas (7, 8) of different hardness arranged in alternation in the transverse direction (9) perpendicular to the respective profile longitudinal plane (10), the sealing profiles (5) of butt sides (3) that lie against each other differing from each other in the arrangement of the areas (7, 8) of different hardness in the transverse direction (9).

9 Claims, 5 Drawing Sheets

(56) References Cited

U.S. PATENT DOCUMENTS

| | | | | | |
|---|---|---|---|---|---|
| 4,762,441 | A | | 8/1988 | Glang | |
| 4,900,607 | A | * | 2/1990 | Glang et al. | 405/152 |
| 4,946,309 | A | | 8/1990 | Glang | |
| 5,172,919 | A | * | 12/1992 | Takasaki et al. | 277/644 |
| 5,879,010 | A | * | 3/1999 | Nilkanth et al. | 277/545 |
| 5,888,023 | A | | 3/1999 | Grabe et al. | |
| 6,129,485 | A | * | 10/2000 | Grabe et al. | 405/152 |
| 6,267,536 | B1 | | 7/2001 | Adachi et al. | |
| 7,431,306 | B2 | * | 10/2008 | Ueta et al. | 277/594 |
| 2002/0153671 | A1 | * | 10/2002 | Raymond et al. | 277/608 |
| 2009/0148658 | A1 | * | 6/2009 | Gutschmidt et al. | 428/131 |

FOREIGN PATENT DOCUMENTS

| | | | |
|---|---|---|---|
| DE | 102005039056 | A1 | 2/2007 |
| DE | 102005039253 | A1 | 2/2007 |
| DE | 102006056055 | A1 | 5/2008 |
| EP | 0222968 | A1 | 5/1987 |
| EP | 0441250 | A1 | 8/1991 |
| EP | 0995013 | A1 | 4/2000 |
| GB | 2017194 | A | 10/1979 |
| GB | 2182987 | A | 5/1987 |
| JP | 48019007 | B | 6/1973 |

* cited by examiner

SEALING ARRANGEMENT FOR SHAFT AND TUNNEL CONSTRUCTIONS

BACKGROUND OF THE INVENTION

1. Field of the Invention

The invention relates to a sealing arrangement for shaft and tunnel constructions.

2. Description of the Related Art

Shaft and tunnel constructions are regularly composed of individual monolithic prefabricated components (tubbings), between which contact joints are present, which are sealed off with suitable seals in order to prevent for example ingress of the surrounding medium (e.g. water).

Generic sealing arrangements are known e.g. from DE 102005039253, DE 102005039056, U.S. Pat. No. 4,946,309, EP 0222968, EP 0441250 and EP 0995013. An elastic sealing profile is introduced into a groove running around the abutting sides of the tubbing. The sealing effect of the sealing system is achieved when joining the tubbings together in that the sealing profiles of adjacent tubbings, which are opposite each other in the joints, are pressed against each other (compression seal). The restoring forces caused by the compression ensure reliable sealing as long as the generated compression pressure exceeds the external pressure present at the seal.

A problem of known sealing arrangements consists in that, when the tubbings are offset with respect to each other owing to positioning errors, the desired mirror-symmetrical arrangement of the sealing elements is not present and contact takes place between the two sealing profiles only on a reduced supporting portion, which results in reduced compressive pressure. This increases the risk of a leak.

BRIEF SUMMARY OF THE INVENTION

The object of the present invention is to improve the sealing of joints between components of shaft and tunnel constructions so that reliable sealing of shaft and tunnel constructions is achieved, in particular even if there is an offset between the components.

The object is achieved with the subject matter of the independent claims. Advantageous embodiments are specified in the dependent claims.

In a first aspect, the present invention provides a sealing arrangement for shaft and tunnel constructions, wherein a) the sealing arrangement comprises at least two components which lie against each other, forming a joint with abutting sides, b) the components each have an elastic sealing profile on the abutting sides, and c) the sealing profiles of abutting sides lie against each other on a contact plane and bridge the joint in a sealing manner, and wherein each of the sealing profiles has regions of the different hardness arranged alternately in the transverse direction perpendicular to the respective profile longitudinal plane, wherein the sealing profiles of abutting sides lying against each other differ from each other in the arrangement of the regions of different hardness in the transverse direction.

The sealing arrangement according to the invention for the first time provides sealing profiles which do not have uniform and mirror-symmetrical elastic properties when arranged without an offset. Each sealing profile has regions of different hardness arranged alternately along the contact plane, the arrangement of the regions of different hardness of the sealing profiles differing from each other so that a "hard" region is essentially opposite a "soft" region when in the use situation without an offset. This makes it possible in the event of an offset of the components which results in an offset of the sealing profiles with respect to each other in the transverse direction, i.e. perpendicularly to the sealing profile longitudinal plane at least largely to prevent a reduction in the compressive pressure. With the sealing arrangement according to the invention and during offset-free installation, a hard region of a sealing profile is pressed at least essentially onto or into a soft region of the opposite sealing profile. In the event of an offset, at least a part of the hard region of one sealing profile is opposite a hard region adjacent to the soft region of the other sealing profile. Although the contact face between the sealing profiles is reduced by the offset, the compressive pressure is not reduced overall, as the pressure is increased by the higher restoring forces in the contact regions in which a hard region lies against a likewise hard region.

The term "regions of different hardness" means parts of an elastic sealing profile which have different restoring forces in the direction of the end of the sealing profile or of the contact plane between two sealing profiles. A "hard" region or "harder" region means a region of a sealing profile which has a higher restoring force than a comparative region. A "soft" region or "softer" region means a region of a sealing profile which has a lower restoring force than a comparative region. A "region" is in this case preferably a part of the sealing profile which is delimited by the front side and base side of the sealing profile and by a flank side and the adjacent region or by two adjacent regions. The regions of different hardness do not necessarily have to be delimited by the base side, i.e. side of the sealing profile which is in contact with the component. Rather, the regions of different hardness can also be provided on a component with uniform hardness and be delimited by the same. The "hardness" of a sealing profile can be set in various ways known to a person skilled in the art, for example by selecting a corresponding material with a suitable Shore hardness and/or by providing hollows or channels in the sealing profile. The "hardness" of a sealing profile can also be influenced by the shape of hollows or channels provided in the sealing profile.

If the term "transverse direction" is used here, this means a direction which is perpendicular to the profile longitudinal plane and runs essentially parallel to the front side of the sealing profile or to the contact plane between two sealing profiles. "Profile longitudinal plane" means a plane which runs in the longitudinal direction of the sealing profile, includes the central longitudinal axis of the sealing profile and is perpendicular to the front side of the sealing profile or contact plane.

The expression "regions arranged alternately" means that regions of different hardness are arranged one behind the other or one next to the other in an alternating manner in the transverse direction, e.g. seen from a flank of the sealing profile, a soft region follows a hard region and another soft region follows the latter.

Within the context of the present invention, a multiplicity of different region hardness combinations are possible, for example soft-hard/hard-soft, soft-hard-soft/hard-soft-hard, soft-hard-soft-hard-soft/hard-soft-hard-soft-hard etc.

Soft regions of one sealing profile preferably have a restoring force which is at least 5, 10, 15, 20, 25, 30, 35, 40, 45, 50 or at least 55%, particularly preferably 20, 25, 30, 35, 40, 45 or 50% lower than the associated hard regions of the other region with a given prestress.

The components can consist of concrete, metal, plastic, wood or other materials, e.g. composite materials.

The regions can be connected to each other preferably permanently by coextrusion, adhesive bonding or other suitable methods known to a person skilled in the art.

In a preferred embodiment of the sealing arrangement according to the invention, when the sealing profiles are arranged without an offset, the regions of differing hardness are arranged in such a manner that in each case one region of a sealing profile is directly opposite a region of the sealing profile which is associated with the said sealing profile and has a different hardness, i.e. two opposite regions of different hardness lie with their central longitudinal axes in a common plane which is perpendicular in relation to the contact plane. A hard region of a sealing profile is therefore directly opposite a soft region of the opposite sealing profile. Mutually opposite regions of different hardness preferably do not overlap each other. It is however also possible for regions of different hardness also to overlap at least partially when the sealing profiles are arranged without an offset. For example, it can be the case with a soft-hard-soft/hard-soft-hard combination that the inner soft region has contact with a part of the two outer soft regions of the opposite sealing profile.

To provide different hardnesses, the regions can have different Shore hardnesses of the material of which the respective region consists and/or have different profile geometries. Different profile geometries are produced preferably by a different size and/or arrangement and/or shape of hollows or channels in the sealing profile.

In a preferred embodiment, each of the sealing profiles of the sealing arrangement according to the invention has at least one region with a first hardness and at least two regions with a hardness which is different from the first hardness. In this preferred embodiment, each of the sealing profiles has a total of three regions, two regions preferably having the same hardness and a preferably central region having a hardness which is higher or lower than this.

One of the sealing profiles particularly preferably has an inner soft region and two flanking outer hard regions, and the opposite sealing profile has an inner hard region and two flanking outer soft regions. It is however easily possible for sealing profiles with more than three, for example four, five, six or seven alternating hardness regions to be provided. In the case of an odd number of alternating hardness regions, it is preferred for one region to be arranged centrally and the other regions to flank this central region symmetrically. In this case it is particularly preferable for the regions on the flanks (lateral outer sides) of the sealing profile having the same contact area altogether as the central region. Any regions between the flank regions and the central region preferably have the same contact area as the central region.

In a preferred embodiment, the regions of different hardness altogether form essentially a contact area of equal size, i.e. all the soft regions of a sealing profile form a contact area which corresponds essentially to the contact area which is formed by the hard regions of the sealing profile.

The sealing profiles particularly preferably consist of an elastomer material. Examples of elastomer materials are natural rubber (NR), styrene-butadiene rubber (SBR), butyl rubber (IIR), ethylene propylene rubber (EPDM), acrylonitrile butadiene rubber (NBR), hydrated acrylonitrile rubber (HNBR), chloroprene rubber (CR), chlorosulphonated polyethylene (CSM), polyacrylate rubber (ACM), polyurethane rubber (PU), silicone rubber (Q), fluorosilicone rubber (MFQ) and fluoro rubber (FPM).

In a second aspect, the invention relates to a sealing profile for components of shaft and tunnel constructions, wherein the sealing profile has the shape of an essentially rectangular frame with four sides, and wherein the sealing profile has regions of different hardness arranged in an alternating manner in the transverse direction perpendicularly to the profile longitudinal plane, and opposite sides each have a different arrangement of the regions of different hardness in the transverse direction. The regions of the sealing profile can be connected to each other preferably permanently by coextrusion, adhesive bonding or other suitable methods known to a person skilled in the art.

A sealing profile according to the second aspect of the present invention can be used particularly advantageously in a sealing arrangement according to the first aspect of the present invention. Sealing profiles for components of shaft and tunnel constructions generally form an essentially rectangular frame, which is e.g. inserted into a groove running around the abutting sides of the components. Although it is possible in the sealing arrangement according to the invention for components with different sealing profiles, i.e. sealing profiles with different arrangements of hardness regions to be provided in the form of a frame profile and for the components to be arranged in such a manner that different sealing profiles are opposite each other, it is preferred for all the components to have the same type of sealing profile. This is made possible in that in each case two adjacent sides of the frame profile belong to one sealing profile type, whereas the other, likewise adjacent sides belong to the other sealing profile type.

The sealing profile preferably has at least one region with a first hardness and at least two regions with a hardness which is different from the first hardness.

Two adjacent sides of the sealing profile particularly preferably have an inner soft region and two flanking outer hard regions, and the remaining sides have an inner hard region and two flanking outer soft regions.

The sealing profile preferably consists of elastomer material, as stated above.

In a third aspect, the invention provides a tunnel or shaft construction which comprises a sealing arrangement or a sealing profile according to the first or second aspect of the invention.

The invention is explained in more detail below using figures which show preferred exemplary embodiments of the invention.

BRIEF DESCRIPTION OF THE SEVERAL VIEWS OF THE DRAWINGS

The present invention is illustrated by way of example and not limitation in the accompanying drawings in which like reference numbers indicate similar parts, and in which.

DETAILED DESCRIPTION OF THE INVENTION

Figure 1:
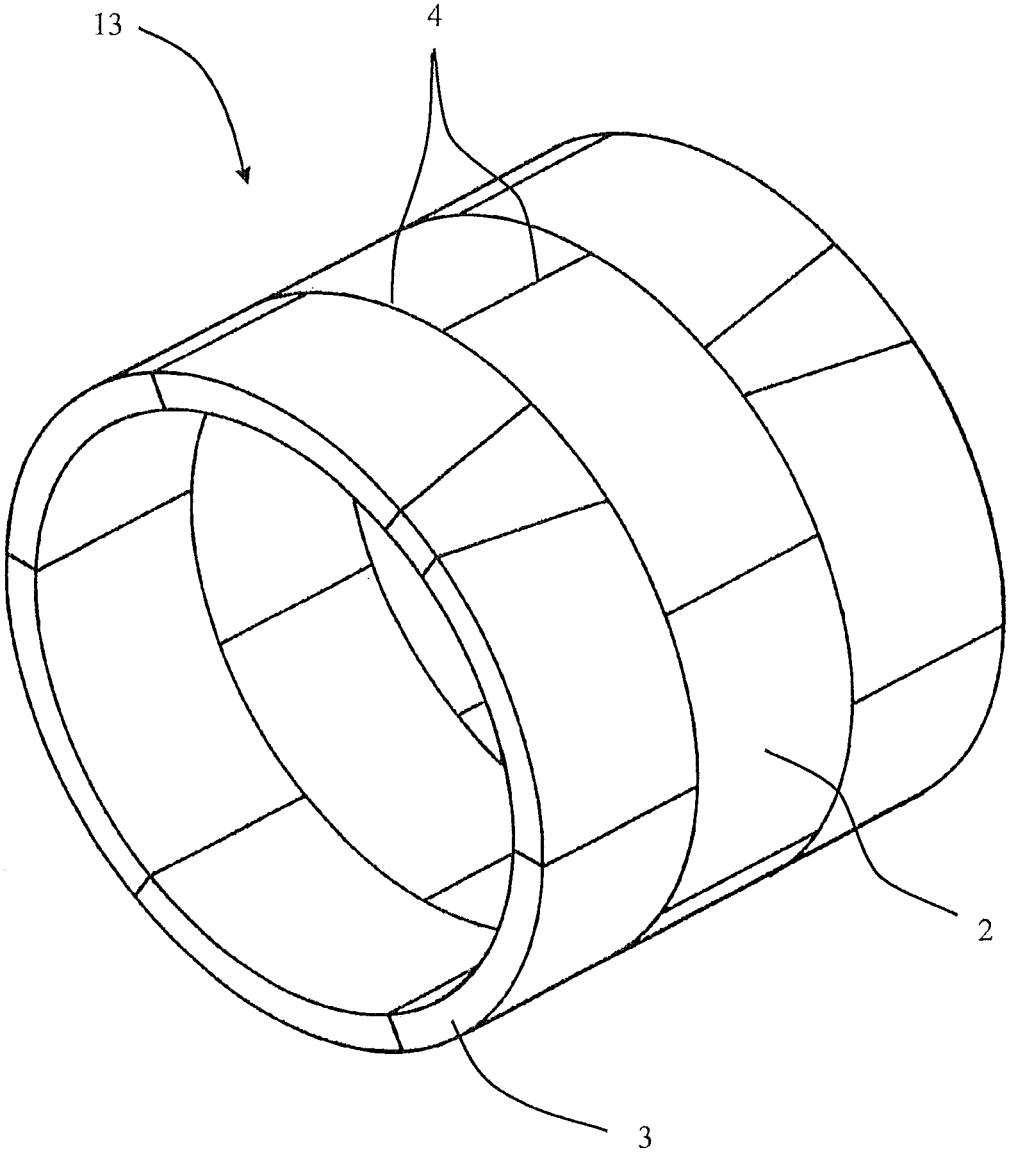
FIG. 1 shows a schematic diagram of a part of a tunnel construction.

FIG. 1 schematically shows a section of a tunnel construction 13 composed of individual components 2, e.g. prefabricated concrete components. Joints 4 are formed between abutting sides 3 of the components 2. The joints 4 are sealed with sealing profiles 5 which are not visible here.

Figure 2:
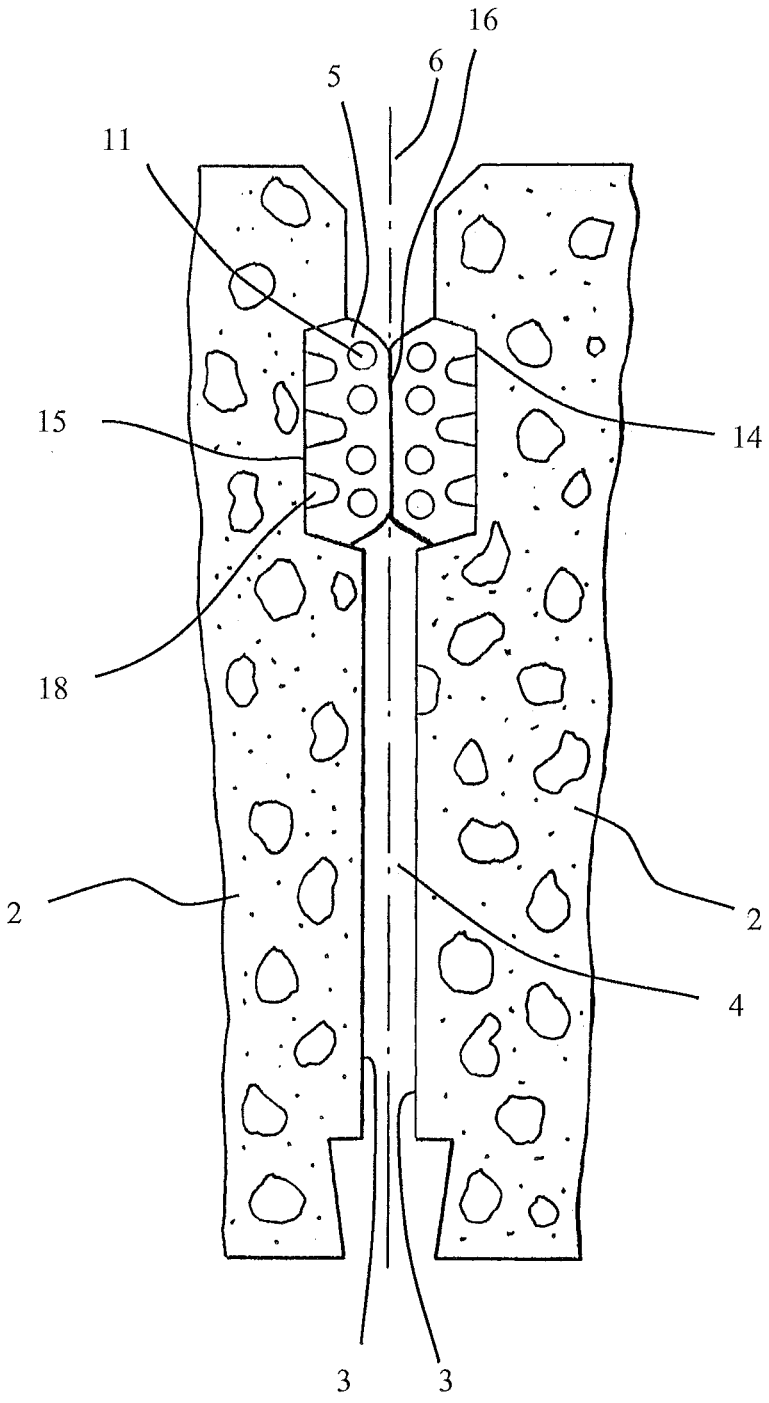
Fig. 2 (PRIOR ART)
FIG. 2 shows a schematic cross-sectional view of a sealing arrangement according to the prior art.

FIG. 2 schematically shows a cross section through a sealing arrangement for concrete tubbings according to the prior art, as is described for example in U.S. Pat. No. 4,946,309. Embodiment of the sealing arrangement 8 according to the invention. A part of two components 2 lying against each other with their abutting sides 3 is shown. The abutting sides 3 of the components 2 form a joint 4 and each have a groove 14 running around the abutting sides 3, into which groove 14 one elastic sealing profile 5 is introduced in each case. The sealing profiles 5 which lie against each other with the profile front sides 16 on a contact plane 6 are arranged mirror-symmetrically with respect to the contact plane 6 and seal the joint 4 off. Flutes 18 are provided on the profile base side 15, channels 11 are provided inside the sealing profile 5.

Figure 3:
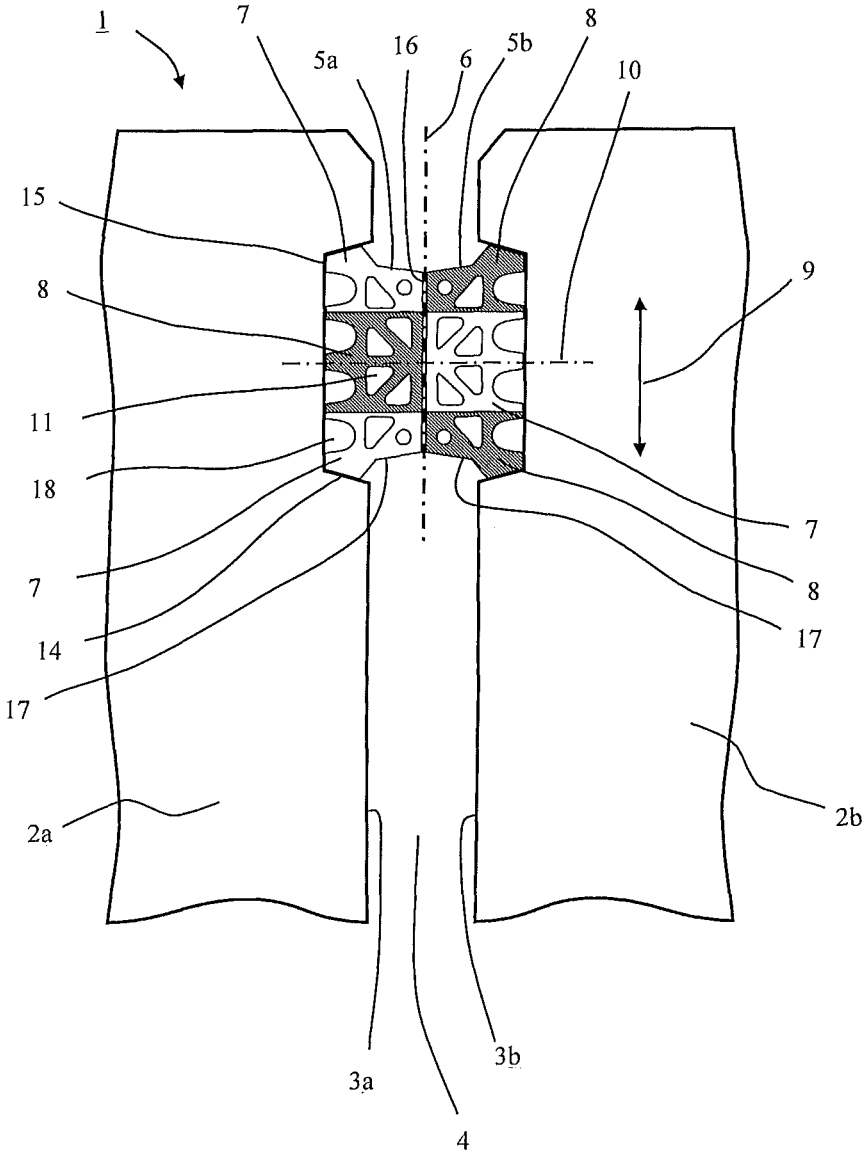
FIG. 3 shows a schematic cross-sectional view of an embodiment of a sealing arrangement according to the invention.

FIG. 3 shows an embodiment of the sealing arrangement 1 according to the invention. Corresponding features are provided with the same reference numerals as in FIG. 2. One sealing profile 5 is introduced in each case into grooves 14 of the components 2, e.g. of a tunnel construction. A part of two components 2 lying against each other with their abutting sides 3 is shown. The sealing profiles 5 which are shown here in the uncompressed state and without an offset with respect to each other lie against each other with the profile front sides 16 in the contact plane 6 and in this manner bridge the joint 4. In the embodiment shown, the sealing profiles 5 have flutes 18 on the profile base side 15 and channels 11 and are for example fixed in the groove 14 by adhesive bonding. The sealing profiles 5 are no mirror-symmetrical with respect to the contact plane 6. Rather, the sealing profiles 5 differ in the arrangement of regions 7, 8 of different hardness. In the embodiment shown here, the different hardness of the regions 7, 8 has been produced by selecting different Shore hardnesses of the elastomer material used for the respective region 7, 8. Both sealing profiles 5 have three regions 7, 8 which are arranged in an alternating manner in the transverse direction 9. In the sealing profile 5*a* shown here on the left with respect to the contact plane 6, a central region 8 produced from a harder material is flanked by regions 7 of softer material, whereas in the sealing profile 5*b* shown on the right seen from the contact plane 6, a softer central region 7 is flanked by harder regions 8. A hard region 8 of one sealing profile 5*a* is directly opposite a soft region 7 of the other sealing profile 5*b* with a contact area of equal size in the contact plane 6, and vice versa. The regions 7, 8 do not overlap in the offset-free state, i.e. a hard region 8 of one sealing profile 5*a* does not overlap the respectively opposite soft region 7 of the other sealing profile 5*b*. In this embodiment, both sealing profiles 5 are mirror-symmetrical with respect to the profile longitudinal plane 10. The sum of the contact areas, i.e. the sum of the areas with which the sealing profiles 5 lie against each other in the contact plane 6 in the offset-free state, is in this case essentially equal for the soft and hard regions 7, 8. The contact areas of the two hard regions 8 of the right-hand sealing profile 5*b* add up to an area which corresponds essentially to the contact area of the central region 7. The situation with the contact areas of the left-hand sealing profile 5*a* corresponds. In the case of an offset in the transverse direction 9, the central hard region 8 of one sealing profile 5*a* overlaps the corresponding hard region 8 of the opposite sealing profile 5*b*, which region is shifted to the profile flank side 17, as a result of which the reduction in the contact area between the sealing profiles can be compensated.

Figure 4:
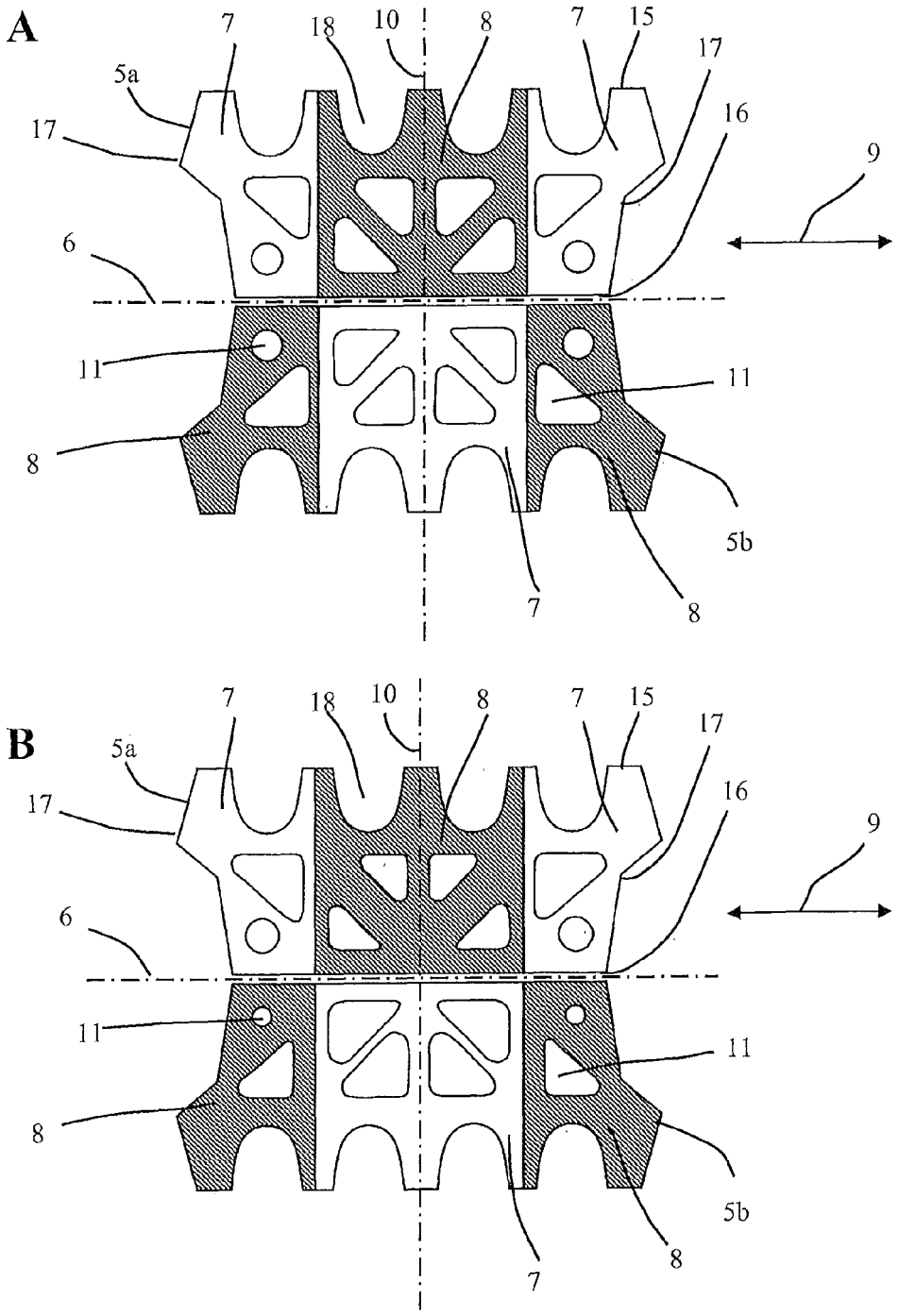
FIG. 4 shows schematic cross-sectional views of embodiments of a sealing profile according to the invention. A. Sealing profiles with regions of different Shore material hardness. B. Sealing profiles with regions of different geometry.

FIG. 4 shows two different variants of a sealing arrangement 1 according to the invention. Only the two sealing profiles 5 are shown for the sake of clarity. The sealing profiles are shown rotated by 90° compared to FIG. 3. In FIG. 4A, the sealing profiles 5 of FIG. 3 are shown again, enlarged. In this configuration, the different hardness of the regions 7, 8 is realised by different Shore hardnesses of the material used for the regions 7, 8. The hard region 8 of the sealing profile 5*a* at the top in relation to the contact plane 6 has a higher Shore hardness than the corresponding opposite region 7 of the bottom sealing profile 5*b*. The profile geometry of the regions 7, 8 lying opposite in the offset-free state is the same in both sealing profiles 5, i.e. the number, shape and arrangement of the channels 11 is the same, i.e. mirror-symmetrical in relation to the contact plane 6. The hard regions 8 and the soft regions 7 in each case have essentially the same Shore hardness as each other. Different Shore hardnesses can however also be provided, which in the case of soft regions 7 are however in each case lower than in the hard region 8 which is opposite in the offset-free state. FIG. 4B shows an embodiment in which different region hardnesses are produced by the profile geometry. The central hard region 8 of the sealing profile 5*a* above the contact plane 6 in the figure has a comparatively larger volume of material, as the channels 11 are designed with a smaller cross section compared to the opposite region 7 of the sealing profile 5*b* below the contact plane 6. The situation with the hard regions 8 flanking the central soft region 8 of the sealing profile 5*b* corresponds. The hardness of a region can be set by the number, size and also shape of the hollows or channels 11. The greater the proportion of solid material in the volume of the respective region, the harder the latter is, in general.

Figure 5:
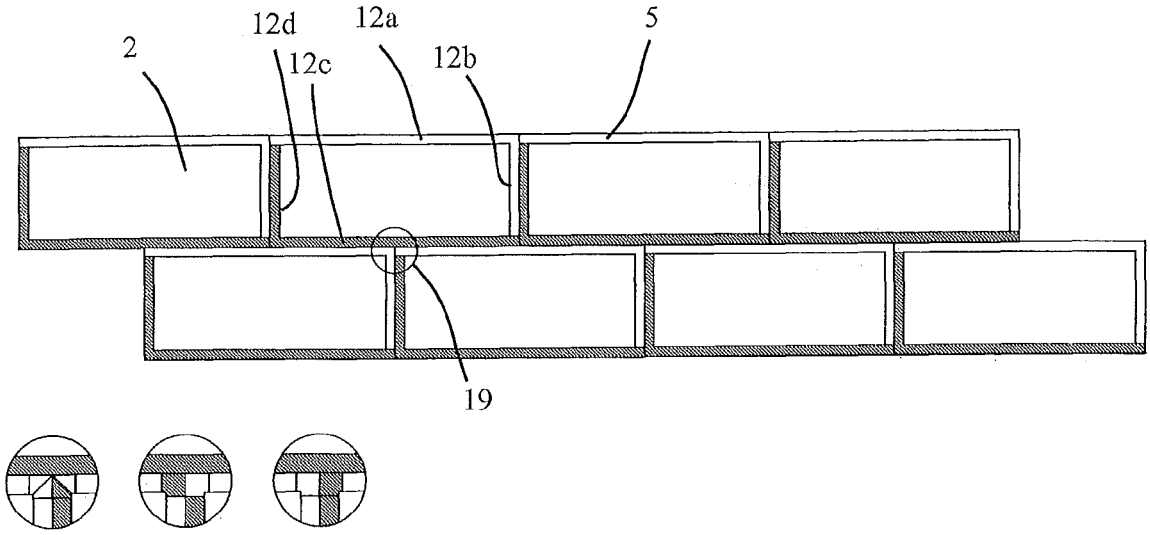
FIG. 5 shows a schematic diagram of an arrangement of a plurality of components having the sealing profiles according to the invention.

FIG. 5 shows in a highly schematic manner an exemplary arrangement of a plurality of components 2 abutting against each other with a preferred embodiment of the profile seal 5 according to the invention in a side view. Two rows of in each case four components 2 are shown, the abutting sides 3 of which are provided with a peripheral frame-like sealing profile 5. Of the four sides 12*a*, 12*b*, 12*c* and 12*d* of the sealing profile 5, in each case two adjacent sides 12*a*, 12*b* and 12*c*, 12*d* are formed the same, i.e. with an identical arrangement of regions, whereas opposite sides have different arrangements of regions. The sides 12*a* and 12*b* for example have an arrangement of the regions 7, 8 in which a central hard region 8 is flanked by two soft regions 7, whereas the sides 12*c* and 12*d* have the opposite arrangement. In the side view, only the flank sides 17 of the sealing profile 5 can be seen. The sides are connected to each other in the corner regions 19. Three examples of preferred configurations of the corner regions 19 are shown in the bottom left of FIG. 5.

LIST OF REFERENCE SYMBOLS

1 Sealing arrangement
2 Component
3 Abutting side
4 Joint
5 Sealing profile
6 Contact plane
7 Region
8 Region
9 Transverse direction
10 Profile longitudinal plane
11 Channel
12 Side
13 Tunnel construction
14 Groove
15 Profile base side
16 Profile front side
17 Profile flank side

18 Flute
19 Corner region

The invention claimed is:

1. A tunnel or shaft construction composed of individual monolithic prefabricated components, the tunnel or shaft construction comprising at least a first component and a second component, wherein a) said first and second components lies against each other with abutting sides, with the abutting sides thereby forming a joint, b) the first component has a first elastic sealing profile and the second component has a second elastic sealing profile, the first and second elastic sealing profiles being arranged on the abutting sides of the first and second components, c) the first and second elastic sealing profiles of the abutting sides lie against each other on a contact plane, thereby bridging the joint in a sealing manner, d) each of the elastic sealing profiles has regions of a first and a second hardness arranged alternately along the contact plane perpendicular to the respective profile longitudinal plane, the second hardness being different from the first hardness, e) the first and second elastic sealing profiles of the abutting sides lying against each other differ from each other in the arrangement of the regions of said first and second hardness along the contact plane perpendicular to the respective profile longitudinal plane, and f) the regions of the first and second hardness are arranged in such a manner that, when the first and second elastic sealing profiles are arranged without an offset, each region of the first elastic sealing profile having the first hardness in each case is opposite a region of the second elastic sealing profile with the second hardness, and does not overlap any region of the second elastic sealing profile having the first hardness, and each region of the first elastic sealing profile having the second hardness in each case is opposite a region of the second elastic sealing profile with the first hardness, and does not overlap any region of the second elastic sealing profile having the second hardness.

2. The tunnel or shaft construction according to claim 1, wherein the regions of first and second hardness differ in material Shore hardness.

3. The tunnel or shaft construction according to claim 2, wherein the regions of the first and second hardness differ in the size and/or arrangement and/or shape of hollows or channels in the sealing profiles.

4. The tunnel or shaft construction according to claim 1, wherein the first elastic sealing profile has at least one region with the first hardness and at least two regions with the second hardness, and the second elastic sealing profile has at least one region with the second hardness and two regions with the first hardness.

5. The tunnel or shaft construction according to claim 4, wherein the first elastic sealing profile has an inner soft region and two flanking outer hard regions, and the second elastic sealing profile has an inner hard region and two flanking outer soft regions.

6. The tunnel or shaft construction according to claim 1, wherein, each region of the first or second elastic sealing profile contacts the opposite region on the contact plane in a contact area, and wherein, within each of the first or second elastic sealing profile, the total size of the contact areas of regions with the first hardness is essentially equal to the total size of the contact areas of regions with the second hardness, such that the total contact area of the regions of the first hardness essentially corresponds to the total contact area of the regions of the second hardness.

7. The tunnel or shaft construction according to claim 1, wherein the first and second elastic sealing profiles consist of elastomer material.

8. The tunnel or shaft construction according to claim 1, wherein the regions of first and second hardness differ in profile geometry, the difference in profile geometry being produced by different size, arrangement or shape of hollows or channels in the first or second elastic sealing profile.

9. A method for sealing a tunnel or shaft structure composed of individual monolithic prefabricated components, comprising:

(a) providing at least a first component and a second component with abutting sides, wherein the first component has a first elastic sealing profile and the second component has a second elastic sealing profile, the elastic sealing profiles being arranged on the abutting sides of the first and second components, each of the first and second elastic sealing profiles of the abutting sides being adapted to lie against each other on a contact plane, and each of the first and second elastic sealing profiles has regions of a first and second hardness arranged alternately along the contact plane perpendicular to the respective profile longitudinal plane, wherein the first and second elastic sealing profiles of the abutting sides lying against each other differ from each other in the arrangement of the regions of the first and second hardness along the contact plane, (b) arranging the first and second components such that the components are lying against each other with said abutting sides, thereby, forming a joint, and the first and second elastic sealing profiles of the abutting sides are lying against each other, thereby bridging the joint in a sealing manner, and the first and second elastic sealing profiles of the abutting sides are arranged without an offset so that a region of the first hardness is opposite a region of the second hardness and does not overlap any opposite region of the first hardness, and (c) moving the first and second components in place against each other to apply a compressive force against the first and second elastic sealing profiles, whereby each region of first hardness of the first elastic sealing profile is pressed at least essentially onto or into a region of second hardness of the opposite second elastic sealing profile and each region of second hardness of the first elastic sealing profile is pressed at least essentially onto or into a region of first hardness of the opposite second elastic sealing profile.

* * * * *